US012653348B2

(12) United States Patent
Sylvester

(10) Patent No.: US 12,653,348 B2
(45) Date of Patent: Jun. 16, 2026

(54) COLLAPSIBLE TOOTHBRUSH STAND

(71) Applicant: Ahmad Rashad Sylvester, Atlanta, GA (US)

(72) Inventor: Ahmad Rashad Sylvester, Atlanta, GA (US)

( * ) Notice: Subject to any disclaimer, the term of this patent is extended or adjusted under 35 U.S.C. 154(b) by 0 days.

(21) Appl. No.: 18/788,470

(22) Filed: Jul. 30, 2024

(65) Prior Publication Data

US 2025/0064268 A1 Feb. 27, 2025

Related U.S. Application Data

(60) Provisional application No. 63/578,164, filed on Aug. 23, 2023.

(51) Int. Cl.

| | |
|---|---|
| ***B65D 25/04*** | (2006.01) |
| ***A45D 44/18*** | (2006.01) |
| ***A47K 1/09*** | (2006.01) |

(52) U.S. Cl.

CPC ..... *A47K 1/09* (2013.01); *A45D 44/18* (2013.01)

(58) Field of Classification Search

CPC ..... A47K 1/09; A45D 44/18

See application file for complete search history.

(56) References Cited

U.S. PATENT DOCUMENTS

| | | | | |
|---|---|---|---|---|
| 1,200,236 | A | 10/1916 | Ray | |
| 1,696,706 | A | 12/1928 | Athon | |
| 2,868,361 | A | 1/1959 | Zilem et al. | |
| 2,880,902 | A * | 4/1959 | Owsen | A45F 3/20 285/302 |
| 3,833,154 | A | 9/1974 | Markowitz | |
| 4,158,413 | A | 6/1979 | Briggs | |
| D270,878 | S | 10/1983 | Sabatella | |
| 4,813,556 | A | 3/1989 | Lawrence | |
| 5,562,518 | A * | 10/1996 | Estrada | A63H 37/00 220/8 |
| 6,666,329 | B1 * | 12/2003 | Charbonneau | A45F 3/20 220/8 |
| 6,736,285 | B2 | 5/2004 | Stewart-Stand | |
| 7,617,927 | B1 * | 11/2009 | Smith, Jr. | A45D 44/18 220/8 |
| 7,866,500 | B1 | 1/2011 | Peggs | |
| 8,333,298 | B2 | 12/2012 | Wojcik et al. | |
| 9,204,761 | B2 | 12/2015 | Volk | |
| 9,296,508 | B2 | 3/2016 | Kanfer et al. | |
| 9,555,926 | B2 * | 1/2017 | Qiu | B65D 21/086 |
| D1,070,216 | S * | 4/2025 | Valenzuela | D34/1 |
| 2004/0055977 | A1 | 3/2004 | Ryan | |
| 2004/0232016 | A1 | 11/2004 | Dietrich | |

(Continued)

*Primary Examiner* — Amy J. Sterling

(74) *Attorney, Agent, or Firm* — Dunlap Bennett & Ludwig PLLC

(57) ABSTRACT

A collapsible toothbrush holder/stand comprising a collapsible body that extends between a substantially disk-shaped (or a substantially flat rectangle-shaped) collapsed position and a substantially conical (or a substantially trapezoidal prism shaped) expanded position, the collapsible body having a plurality of collapsing ridges extending around the circumference of the collapsible body and formed of a microbial resistant material, the top end having an aperture therein for accepting a toothbrush. The collapsible toothbrush holder/stand may further comprise a travel case for storing and transporting he holder when in its collapsed configuration.

6 Claims, 4 Drawing Sheets

(56) References Cited

U.S. PATENT DOCUMENTS

| | | | | |
|---|---|---|---|---|
| 2011/0198453 | A1 | 8/2011 | Volk | |
| 2011/0248040 | A1 | 10/2011 | McGregor | |
| 2022/0010482 | A1* | 1/2022 | Abrams | A45C 13/103 |
| 2023/0094850 | A1 | 3/2023 | Hunter et al. | |

* cited by examiner

COLLAPSIBLE TOOTHBRUSH STAND

CROSS-REFERENCE TO RELATED APPLICATION

This application claims the benefit of priority of U.S. provisional application No. 63/578,164, filed Aug. 23, 2023, the contents of which are herein incorporated by reference.

BACKGROUND OF THE INVENTION

The present invention relates to toothbrushes and, more particularly, to a collapsible toothbrush holder/stand.

Even when traveling or camping, people need to brush their teeth and maintain their oral hygiene. However, it is often difficult to find a convenient and clean place to put a toothbrush when traveling or camping. Conventional travel toothbrush holders are bulky or unsanitary, making them difficult to pack or carry and allowing germs to flourish on the toothbrush. One such conventional solution people often resort to is using hotel/motel cups to hold their toothbrush. However, numerous undercover reports have found that hotel/motel cups are not cleaned well and, consequently, are covered with microbes that can cause people to fall ill.

As can be seen, there is a need for a toothbrush holder that is easy to travel with and keeps a toothbrush clean when it is not being used. The present invention solves these and other problems with conventional devices by providing a collapsible toothbrush holder/stand made of microbial resistant materials. The present invention is thus convenient to travel with and helps prevent the proliferation of germs on the toothbrush.

SUMMARY OF THE INVENTION

In one aspect of the present invention, there is disclosed a collapsible toothbrush holder/stand. In a preferred embodiment, the collapsible toothbrush holder/stand comprises a collapsible body, an aperture, a base ring, and a base cover. The collapsible body may be placed in at least a collapsed position or an expanded position. The collapsible body may be substantially conical when in the expanded position and substantially disc-shaped when in the collapsed position. The collapsible body may further have a plurality of collapsing ridges extending around the circumference of the collapsible body.

In another aspect of the invention, a collapsible toothbrush holder/stand comprising a collapsible body that extends between a substantially trapezoidal prism shape when in the expanded position and a substantially flat rectangle shape when in the collapsed position. The collapsible body may further have a plurality of collapsing ridges extending around the perimeter of the collapsible body. In preferred embodiments, the collapsible body comprises a microbial resistant material, such as silicone.

These and other features, aspects and advantages of the present invention will become better understood with reference to the following drawings, description and claims.

DETAILED DESCRIPTION OF THE INVENTION

Figure 1:
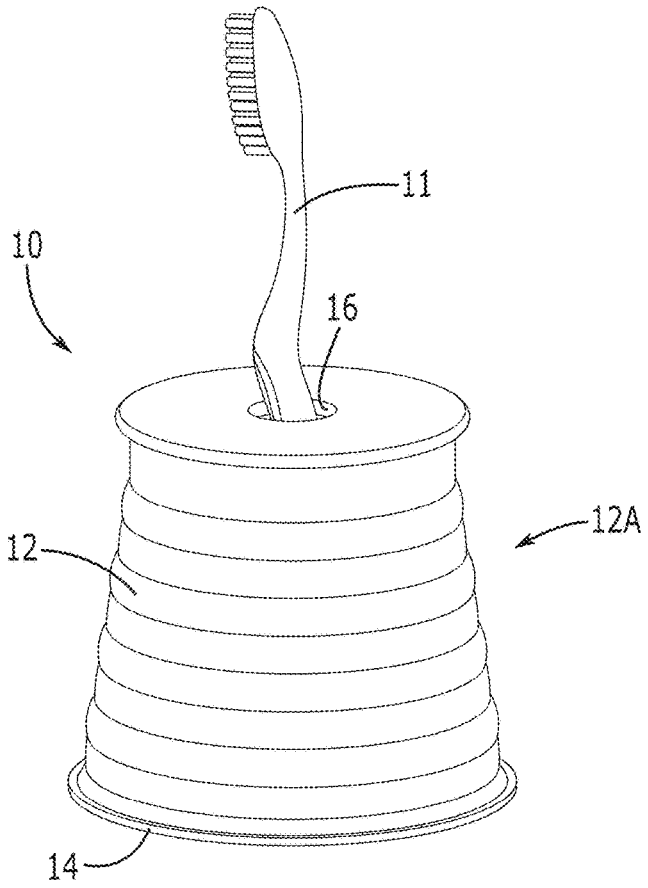
FIG. 1 is a top perspective view of a toothbrush holder/stand in accordance with a preferred embodiment of the present invention.
Figure 2:
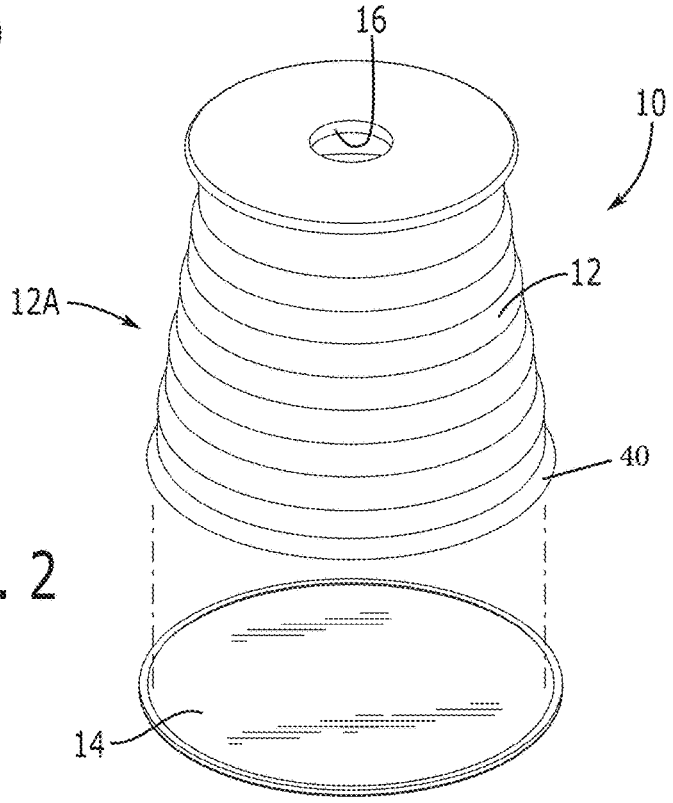
FIG. 2 is an exploded perspective view of a toothbrush holder/stand in accordance with a preferred embodiment of the present invention.
Figure 3:
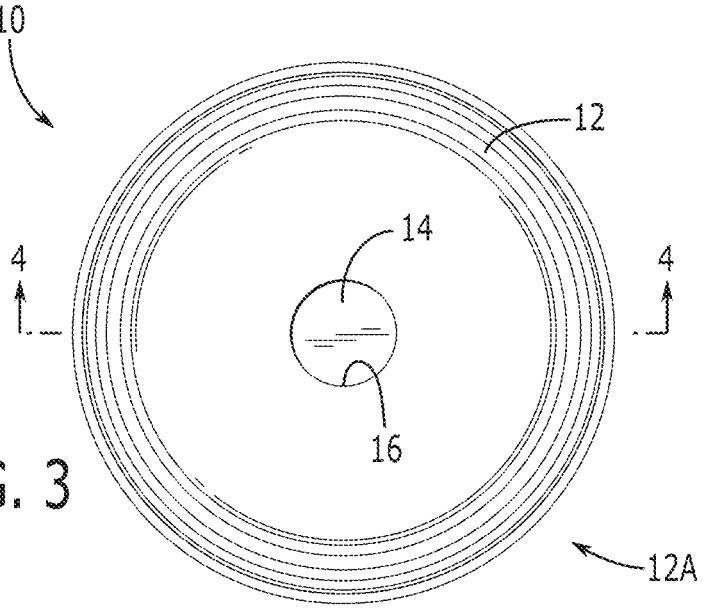
FIG. 3 is a top plan view of a toothbrush holder/stand in accordance with a preferred embodiment of the present invention.
Figure 4:
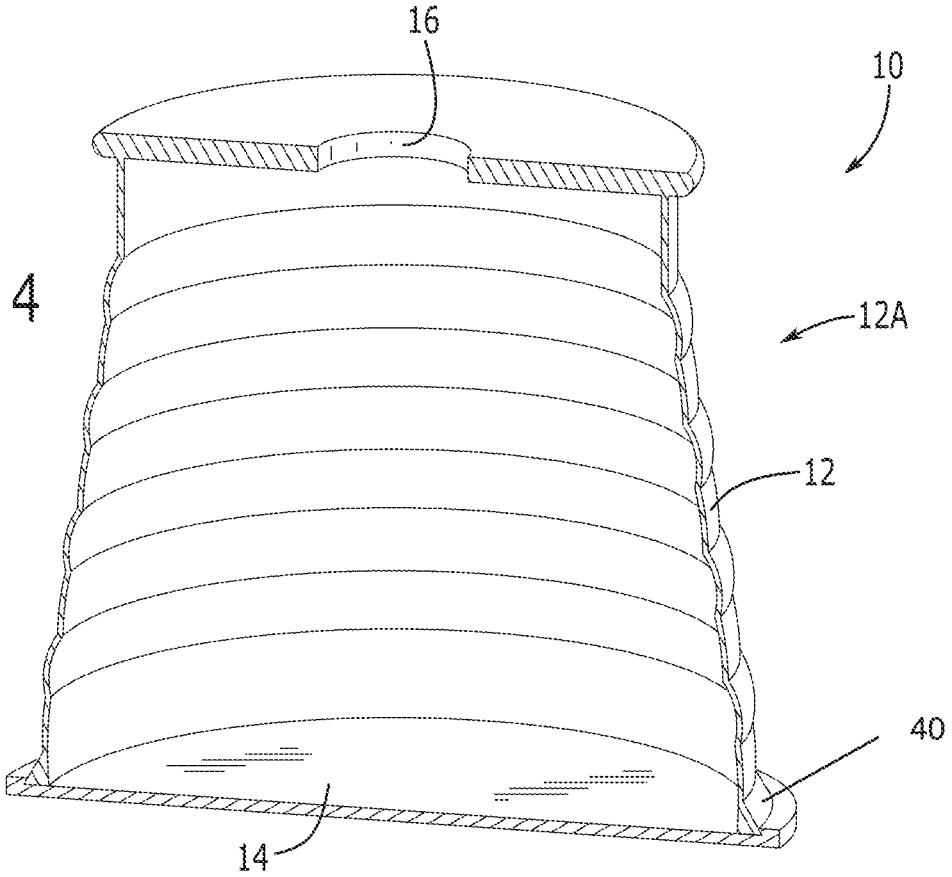
FIG. 4 is a central cross sectional view taken along line 4-4 of the toothbrush holder/stand of FIG. 3.
Figure 5:
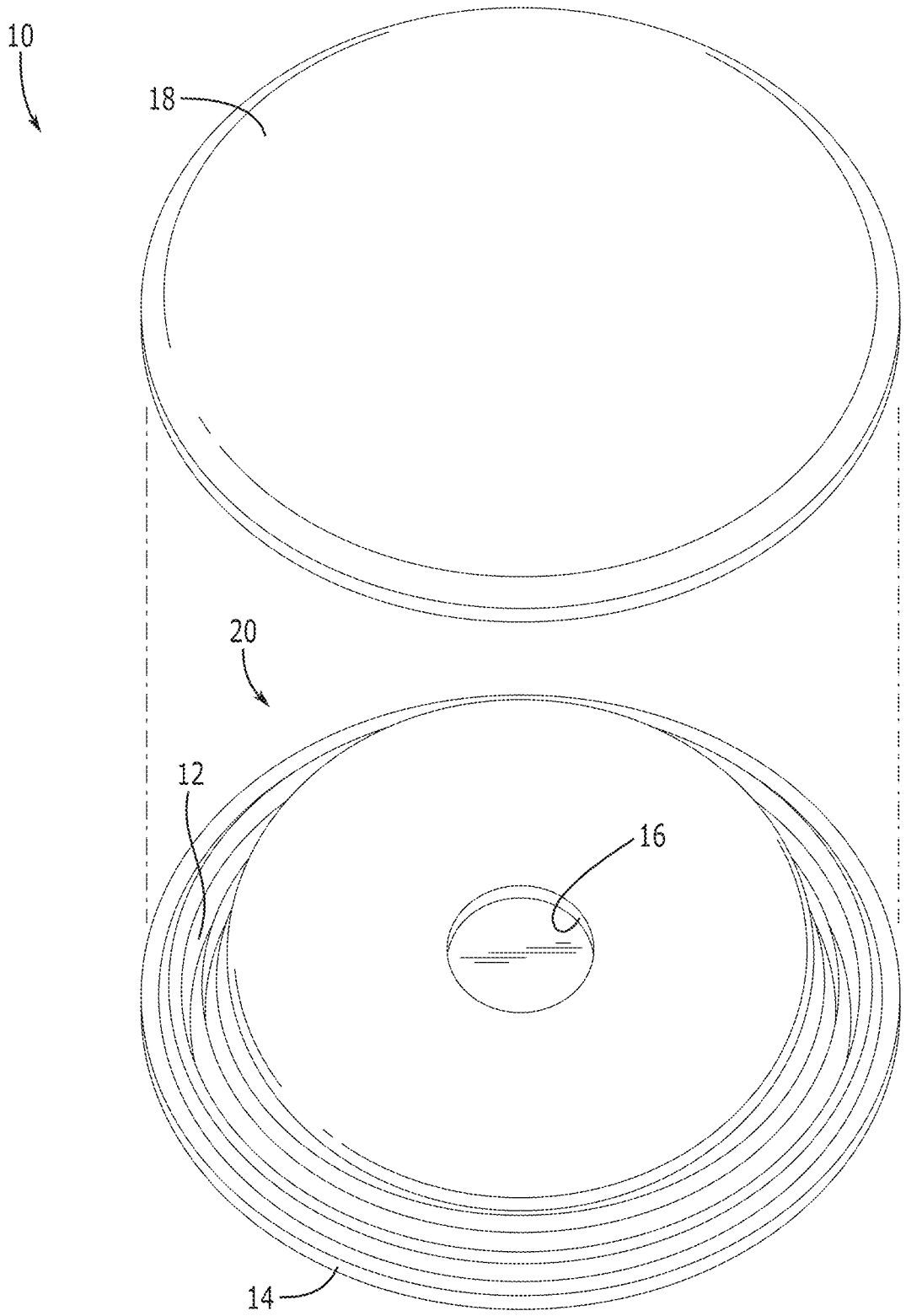
FIG. 5 is an exploded top plan view, showing a travel cover for use in connection with a toothbrush holder/stand in accordance with a preferred embodiment of the present invention.
Figure 6:
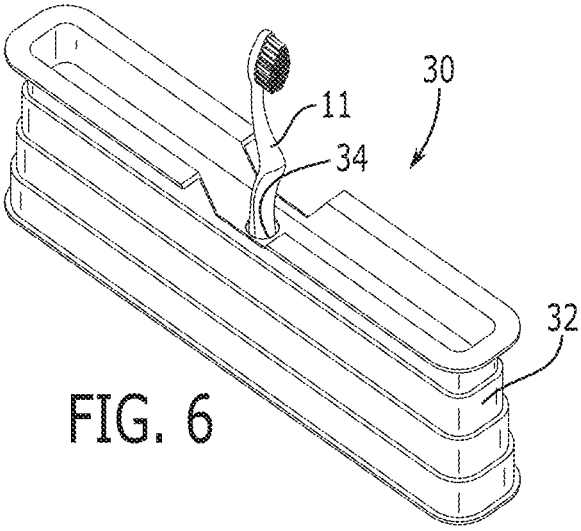
FIG. 6 is a top perspective view of a toothbrush holder/stand in accordance with an alternative preferred embodiment of the present invention, shown in an expanded position.
Figure 7:
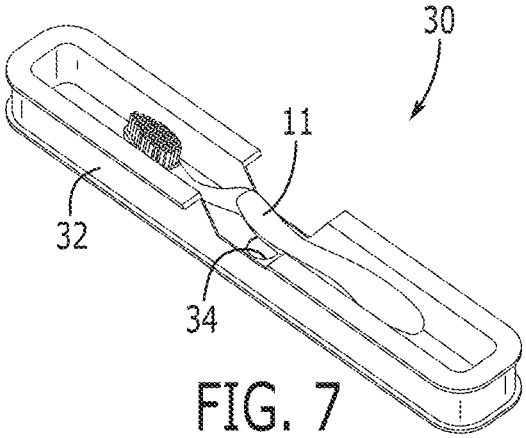
FIG. 7 is a top perspective view of a toothbrush holder/stand in accordance with an alternative preferred embodiment of the present invention, shown in an collapsed position.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a collapsible toothbrush holder/stand. In a preferred embodiment, the collapsible toothbrush holder/stand comprises a collapsible body, an aperture, a base ring, and a base cover. The collapsible body may be placed in at least a collapsed position or an expanded position. The collapsible body may be substantially conical when in the expanded position and substantially disc-shaped when in the collapsed position. The collapsible body may further have a plurality of collapsing ridges extending around the circumference of the collapsible body.

The aperture may be integrally formed with the holder at the first end of the collapsible body. The aperture may comprise at least one hole configured to receive and loosely retain a toothbrush.

At a second end of the collapsible body, opposite to the first end of the collapsible body, a base ring is formed. The base ring is formed such that the collapsible body may be fully encompassed by the base ring when the collapsible body is in the collapsed position. When the collapsible body is in the expanded state, the base ring forms a base upon which the collapsible body rests such that the collapsible body may receive and hold a toothbrush within the holder.

A base cover releasably couples to the base ring to enclose the second end of the collapsible body and encircle the base ring.

Thus, the present invention is able to provide a sturdy, convenient, and sanitary means for holding a toothbrush while a person is traveling or camping.

It should be noted that the materials comprising the present invention are not particularly limited. For example, the base ring may be formed of metal, plastic, or another material that is similarly strong and durable to house and provides support to the collapsible body.

Further, it should be noted that the methods of manufacturing the present invention are not particularly limited. For example, the base ring may be formed via casting, molding, machining, or 3-D printing among other methods.

Referring now to FIGS. 1-9, embodiments of the present invention are shown in greater detail. With specific reference to FIGS. 1-5, a collapsible toothbrush holder/stand in accordance with a first embodiment of the present invention is shown. The collapsible toothbrush holder/stand 10 comprises a collapsible body 12, a holder or aperture 16, and a base cover 14. The collapsible body 12 may be placed in at least a collapsed position 20 (see FIG. 5 by way of example) or an expanded position 12A (see FIG. 1, by way of example). The collapsible body 12 may be substantially conical when in the expanded position and substantially disc-shaped when in the collapsed position. The collapsible body 12 may further have a plurality of collapsing ridges extending around the circumference of the collapsible body. In preferred embodiments, the collapsible body comprises a microbial resistant material, such as silicone.

The aperture 16 is coupled to a first end of the collapsible body 12 and may be integrally formed with the holder 10 at the first end of the collapsible body. The aperture 16 may comprise at least one hole configured to receive and loosely retain a toothbrush 11. Further, the holder 10 may include at least one tab extending away from the holder and configured to be pulled or pushed by a user to cause the collapsible body to move between the expanded (12A) or collapsed (20) position, respectively. Alternatively, the one hole 16 may be pulled or pushed by the user to cause the collapsible body to move between the expanded or collapsed positions, respectively. In preferred embodiments, the holder 10 comprises a microbial resistant material, such as silicone.

At a second end of the collapsible body 12, opposite to the first end of the collapsible body, a base ring 40 is formed. When the collapsible body is in the expanded state, the base ring 40 forms a base upon which the collapsible body rests such that the collapsible body may receive and hold a toothbrush 11 within the holder. A travel cover 18 can releasably couple to the base ring 40 to enclose the second end of the collapsible body 12 and encircle the base ring 40. The cover 18 may include at least one tab configured to allow the base cover to be easily removed from the base ring.

With reference now to FIGS. 6-9, a collapsible toothbrush holder/stand 30 in accordance with a second embodiment of the present invention is shown. The collapsible toothbrush holder/stand 30 comprises a collapsible body 32, a slot 34, a base ring 42, and a base case having a first half 36 and second half 38. The collapsible body 32 may be placed in at least a collapsed position (See FIG. 7, by way of example) or an expanded position (see FIG. 6, by way of example). The collapsible body 32 may be a substantially trapezoidal prism when in the expanded position and a substantially flat rectangle when in the collapsed position. The collapsible body 12 may further have a plurality of collapsing ridges extending around the perimeter of the collapsible body. In preferred embodiments, the collapsible body comprises a microbial resistant material, such as silicone.

The slot 34 is integrally formed with a first end of the collapsible body. The slot 34 may comprise one or more holes configured to receive and loosely retain a toothbrush 11.

Figure 8:
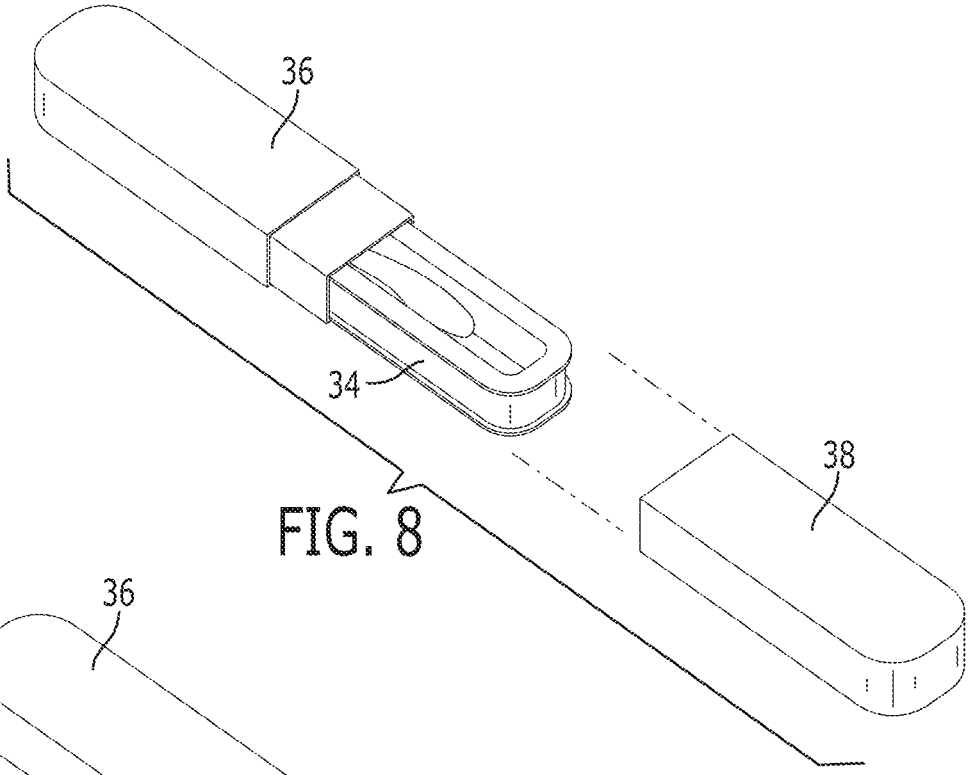
FIG. 8 is a top perspective view of a toothbrush holder/stand in accordance with an alternative preferred embodiment of the present invention, shown being placed in a case with the case in an open position.
Figure 9:
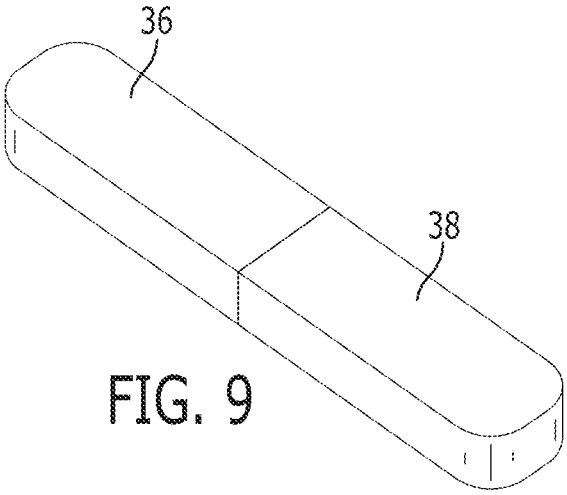
FIG. 9 is a top perspective view of the toothbrush holder/stand of FIG. 8, shown with the case in a closed position.

At a second end of the collapsible body 32, opposite to the first end of the collapsible body, a base ring is formed. When the collapsible body is in the expanded state, the base ring forms a base upon which the collapsible body rests such that the collapsible body may receive and hold a toothbrush within the holder. The collapsable body 32 can be placed in a case 36/38 when in its collapsed configuration as seen in FIGS. 8 and 9. In a preferred embodiment, the case comprises a first half 36 which is designed and constructed to accept toothbrush holder 30 when in its collapsed configuration. The second half 38 of the base is configured to releasably attach to the first half of the case 36 for storing toothbrush 11 in a hygienic manner.

Thus, the present invention is able to provide a sturdy, convenient, and sanitary means for holding a toothbrush while a person is traveling or camping.

Further, while the present invention has been discussed primarily in regards to holding a toothbrush, the present invention may be utilized for other purposes. For example, the present invention may also act as a sanitary holder for dental tools, like picks and scrapers, for writing instruments, like pens and pencils, or for painting supplies, like small brushes, among other similarly shaped objects. The present invention may broadly be a holder for slender objects that is convenient for travel and sanitary.

It should be understood, of course, that the foregoing relates to exemplary embodiments of the invention and that modifications may be made without departing from the spirit and scope of the invention as set forth in the following claims.

What is claimed is:

1. The collapsible toothbrush holder/stand comprising a collapsible body that extends between a substantially flat rectangle-shaped collapsed position and a substantially trapezoidal prism shaped expanded position;

the collapsible body having a plurality of collapsing ridges extending around the circumference of the collapsible body and formed of a microbial resistant material;

the collapsable body having a substantially rectangular shaped top end for accepting a toothbrush when in a collapsed configuration;

the top end having an aperture therein for accepting a toothbrush when in an expanded configuration, and further comprising a case for storing and transporting collapsible toothbrush holder/stand when in its collapsed configuration.

2. The collapsible toothbrush holder/stand of claim 1, wherein the collapsible body comprises a silicone material.

3. The collapsible toothbrush holder/stand of claim 1, wherein the case comprises a first half and a second half, the first half designed and constructed to accept the collapsible toothbrush holder/stand when in the collapsed configuration, and the second half configured to releasably attach to the first half.

4. The collapsible toothbrush holder/stand of claim 3, wherein the case is configured to store a toothbrush together with the collapsible toothbrush holder/stand when in the collapsed configuration.

5. The collapsible toothbrush holder/stand of claim 1, further comprising a base ring formed at a second end of the collapsible body opposite the top end, wherein the base ring forms a base upon which the collapsible body rests when in the expanded position.

6. The collapsible toothbrush holder/stand of claim 1, wherein the aperture is integrally formed with the collapsible body at the top end.

* * * * *